US011136788B2

(12) United States Patent
Telljohann et al.

(10) Patent No.: US 11,136,788 B2
(45) **Date of Patent: *Oct. 5, 2021**

(54) DOOR IMPROVEMENTS AND DATA MINING VIA ACCELEROMETER AND MAGNETOMETER ELECTRONIC COMPONENT

(71) Applicant: Schlage Lock Company LLC, Carmel, IN (US)

(72) Inventors: Brian A. Telljohann, Indianapolis, IN (US); Ryne Rayburn, Fishers, IN (US); Matthew R. Dexter, Indianapolis, IN (US); Gregory Ross, Carmel, IN (US); John Evenson, Greentown, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/373,249

(22) Filed: Apr. 2, 2019

(65) Prior Publication Data

US 2019/0330885 A1 Oct. 31, 2019

Related U.S. Application Data

(63) Continuation of application No. 15/991,342, filed on May 29, 2018, now Pat. No. 10,246,903, which is a (Continued)

(51) Int. Cl.
*G08B 13/08* (2006.01)
*E05B 41/00* (2006.01)
(Continued)

(52) U.S. Cl.
CPC ..... *E05B 41/00* (2013.01); *G08B 13/08* (2013.01); *E05B 2045/063* (2013.01);
(Continued)

(58) Field of Classification Search
None
See application file for complete search history.

(56) References Cited

U.S. PATENT DOCUMENTS 6,310,549 B1 10/2001 Loftin et al.
6,724,316 B2 4/2004 Addy et al.
(Continued)

FOREIGN PATENT DOCUMENTS

WO 2014151692 A2 9/2014
WO 2014154738 A1 10/2014

OTHER PUBLICATIONS

International Search Report; International Searching Authority, US Patent and Trademark Office; International Application No. PCT/US2016/035202; dated Aug. 30, 2016; 2 pages.
(Continued)

*Primary Examiner* — Julie B Lieu
(74) *Attorney, Agent, or Firm* — Taft Stettinius & Hollister LLP

(57) ABSTRACT

An electronic door lock including a magnetometer, an accelerometer, and a processor. The processor is configured to determine a status of a door with respect to a door frame using data provided by the accelerometer and magnetometer which collectively generate acceleration data, velocity data and positional data of the door. The processor provides data to a user interface or an alert device indicating one or more of: door open angle, prep-less door position, an acceleration alert, a door position alert, door sag, door frame rub, and triangulation of an intruder.

23 Claims, 5 Drawing Sheets

Related U.S. Application Data continuation of application No. 15/162,742, filed on May 24, 2016, now Pat. No. 9,982,459.

(60) Provisional application No. 62/169,092, filed on Jun. 1, 2015.

(51) Int. Cl.
*E05B 47/00* (2006.01)
*E05B 45/06* (2006.01)
*E05B 63/00* (2006.01)

(52) U.S. Cl.
CPC . *E05B 2045/067* (2013.01); *E05B 2047/0068* (2013.01); *E05B 2047/0094* (2013.01); *E05B 2063/0095* (2013.01)

(56) References Cited

U.S. PATENT DOCUMENTS

| | | | | |
|---|---|---|---|---|
| 6,918,276 | B2 | 7/2005 | Van Parys | |
| 7,692,542 | B2 | 4/2010 | Outzs | |
| 8,325,039 | B2 | 12/2012 | Picard et al. | |
| 8,847,580 | B1 | 9/2014 | Smith | |
| 8,907,791 | B2 | 12/2014 | Yulkowski et al. | |
| 8,922,370 | B2 | 12/2014 | Picard et al. | |
| 2008/0246607 | A1 | 10/2008 | Smith | |
| 2009/0249699 | A1 | 10/2009 | Yulkowski et al. | |
| 2011/0016971 | A1 | 1/2011 | Yulkowski et al. | |
| 2013/0057404 | A1* | 3/2013 | Thibault | G08B 29/22 340/545.1 |
| 2013/0057405 | A1 | 3/2013 | Seelman et al. | |
| 2013/0265162 | A1 | 10/2013 | Buckley et al. | |
| 2013/0314232 | A1 | 11/2013 | Jerhotova et al. | |
| 2013/0327142 | A1 | 12/2013 | Hogan et al. | |
| 2014/0139681 | A1 | 5/2014 | Jones, Jr. et al. | |
| 2016/0040460 | A1* | 2/2016 | Kasai | E05B 45/12 292/251.5 |
| 2016/0054148 | A1* | 2/2016 | Misfatto | E06B 7/28 73/514.02 |
| 2017/0162011 | A1* | 6/2017 | Hsu | G08B 29/183 |
| 2017/0307651 | A1* | 10/2017 | Ten Kate | A47B 88/00 |
| 2018/0038159 | A1* | 2/2018 | Kincaid | E06B 7/28 |
| 2018/0089969 | A1* | 3/2018 | Modi | G01B 7/14 |
| 2019/0153764 | A1* | 5/2019 | Baumgarte | E05F 15/77 |

OTHER PUBLICATIONS

Written Opinion; International Searching Authority, US Patent and Trademark Office; International Application No. PCT/US2016/035202; dated Aug. 30, 2016; 7 pages.

European Extended Supplemental Search Report; European Patent Office; European Patent Application No. 16804300.8; dated Jan. 4, 2019; 6 pages.

European Examination Report; European Patent Office; European Patent Application No. 16804300.8; dated Mar. 5, 2020; 4 pages.

European Examination Report; European Patent Office; European Patent Application No. 16804300.8; dated Oct. 20, 2020; 4 pages.

* cited by examiner

DOOR IMPROVEMENTS AND DATA MINING VIA ACCELEROMETER AND MAGNETOMETER ELECTRONIC COMPONENT

CROSS-REFERENCE TO RELATED APPLICATION

This application is a continuation of U.S. patent application Ser. No. 15/991,342 filed on May 29, 2018 and issued as U.S. Pat. No. 10,246,903, which is a continuation of U.S. patent application Ser. No. 15/162,742 filed on May 24, 2016 and issued as U.S. Pat. No. 9,982,459, which claims the benefit of U.S. Provisional Application No. 62/169,092 filed on Jun. 1, 2015, the contents of each application are hereby incorporated by reference in their entirety.

FIELD OF THE INVENTION

The present disclosure relates to a security device, and more particularly to a door lock for securing a door.

BACKGROUND

Existing electronic door locks are used to provide access to different parts of a building or other facility. Such door locks provide entrance to a room, for instance, in response to a mechanical or electrical actuation of a bolt extending from a door which engages a receiving portion of a frame. Electronic door locks can be isolated individual devices or can be found in an electronic lock system which provides electronic communication between the electronic lock and a control system. Some electronic locks systems are hardwired to an interface device which monitors and controls the state of the electronic lock. Other electronic lock systems employ wireless electronic locks that communicate with a wireless interface device, also known as a panel interface module, sufficiently proximate to the electronic locks to enable radio communication. The interface device is configured to monitor and control the state of a predetermined number of electronic locks, such that multiple interfaced devices can be required in a facility of a large size, since one interface device can be insufficient to monitor and control all of the electronic locks in the facility. Consequently, a number of interface devices are hardwired to a central controller, also known as an access control panel, and are connected to the computer system of the facility. In some facilities, more than one access control panel can be required. The computer system provides updates to the electronic locks through this radio communication network.

In one configuration of a known lock system, a reed switch is used in the frame of the door to detect a magnet disposed in the door. The proximity of the magnet to the reed switch indicates when the door is open or closed. This information is available to the interface device and can be used by the computer system to determine a door closed or door open status of each of the doors in the electronic lock system. While this information is quite useful, additional information indicating a state of the door with respect to the door frame at other than a door closed or a door open position is desirable. For instance, the reed switch configuration cannot determine door sag, door frame rub, the presence of tailgaters. Consequently, what is needed is a method and apparatus to determine the status of one or more doors with respect to a door frame which overcomes the deficiencies of the reed switch system.

SUMMARY

In one embodiment, there is provided a system, components, devices, and methods for communicating the status of one or more doors incorporating electronic door locks in an electronic lock system, including determining the status of one or more doors with respect to a respective door frame. Other embodiments include apparatuses, systems, devices, hardware, methods, and combinations improving door status information in electronic lock systems.

An electronic door lock includes a magnetometer, an accelerometer, and a processor. The processor is configured to determine a status of a door with respect to a door frame using data provided by the accelerometer and magnetometer which collectively generate acceleration data, velocity data and positional data of the door. The processor provides data to a user interface or an alert device indicating one or more of: a door open angle, a prep-less door position, an acceleration alert, a door position alert, door sag, door frame rub, and triangulation of an intruder.

In another embodiment, there is provided a method for determining a status a door with respect to a door frame. The method includes: providing an accelerometer in a door lock; providing a magnetometer in a door lock; determining accelerometer data of the door using the accelerometer; determining magnetometer data of the door using the magnetometer; and providing a status of the door with respect to the door frame using the determined accelerometer data and the determined magnetometer data.

In still another embodiment, there is provided an electronic door lock for a door including a processor and an accelerometer, operatively connected to the processor, and configured to provide acceleration data of the door. The electronic door lock further includes a magnetometer, operatively connected to the processor, and configured to provide magnetometer data of the door. The processor is configured to execute stored program instructions to provide a status of the door with respect to the door frame using the determined accelerometer data and the determined magnetometer data.

BRIEF DESCRIPTION OF THE DRAWINGS

The description herein makes reference to the accompanying figures wherein like reference numerals refer to like parts throughout the several views, and wherein.

DESCRIPTION

Figure 1:
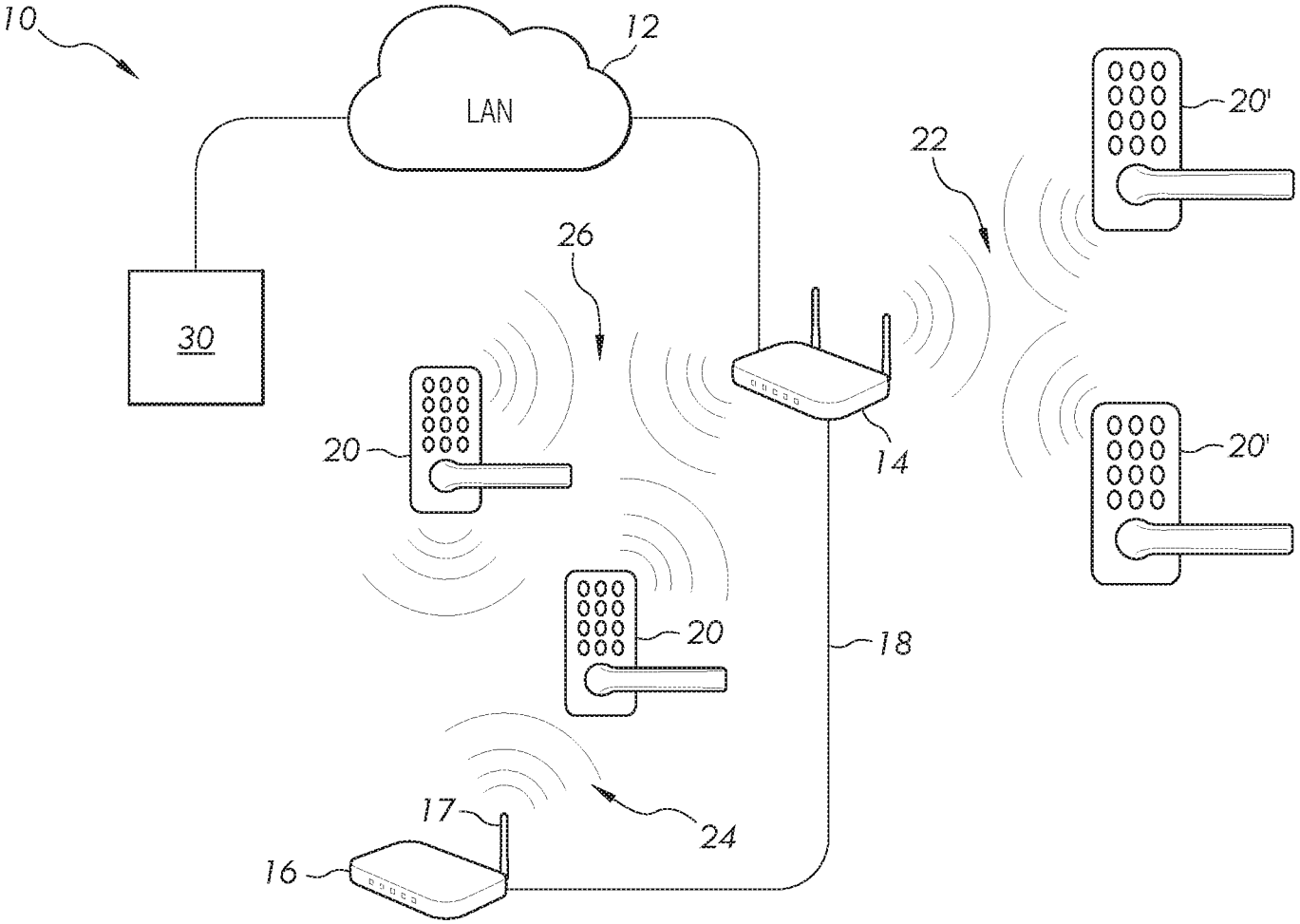
FIG. 1 is a schematic view of an example wireless lock system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

FIG. 1 illustrates a plurality of access devices 20, in the form of wireless door locks, e.g. for use on an entrance door of a building, room or other part of a structure, that is configured to receive RF signals as part of an RF network 24. While access devices, and in particular door locks are illustrated, other locking devices, including exit devices such as crash bars and push pads, are also included.

The door locks 20 are also configured to send and receive signals to computer network 12 via a WI-FI connection 26. It should be understood that many other devices, in different embodiments, send and receive RF signals as part of the RF network 24 and WI-FI connection 26 and the illustrated door lock is simply an example of one of these devices. The received RF signals received by the door lock are configured to change or modify the operating conditions or operating status of the door lock and the door. For instance, the operating status includes a door open position, a door closed position, any position between the door open and closed positions, and a door lock in a locked state and an unlocked state.

In the RF network 24, each door lock 20 acts as a communication node that receives a radio signal as a wakeup signal from an access control device 30 through its assigned bridge device 16, also described as a panel interface module. The access control device 30 is configured to provide system instructions and to receive signals from both the interface module 16. The door locks 20 communicate to send and receive information packets via the RF network or via a WI-FI connection 26 with computer network 12 to other devices in the system 10, such as the access control device 30. If a wakeup signal is not addressed to the door lock 20 in RF network 24, the door lock 20 ignores the wakeup signal. If the particular wakeup signal is addressed to the door lock 20 that interrogates it, the door lock 20 is awakened from a sleep mode and operates in a wake or run mode to communicate with access control device 30. In this arrangement, a battery operating life of each door lock 20, if a battery is included, is maintained since only door locks 20 that are designated to receive information from access control device 30 are awakened in real time for information downloads and uploads. The interrogation of the wakeup signal by door lock 20 occurs in conjunction with radio frequency communications, increasing battery life since the bridge device 16 transmits RF signals and the RF receiver of the access device 20 can operate at a lower power level when compared to standard wireless networks.

Figure 2:
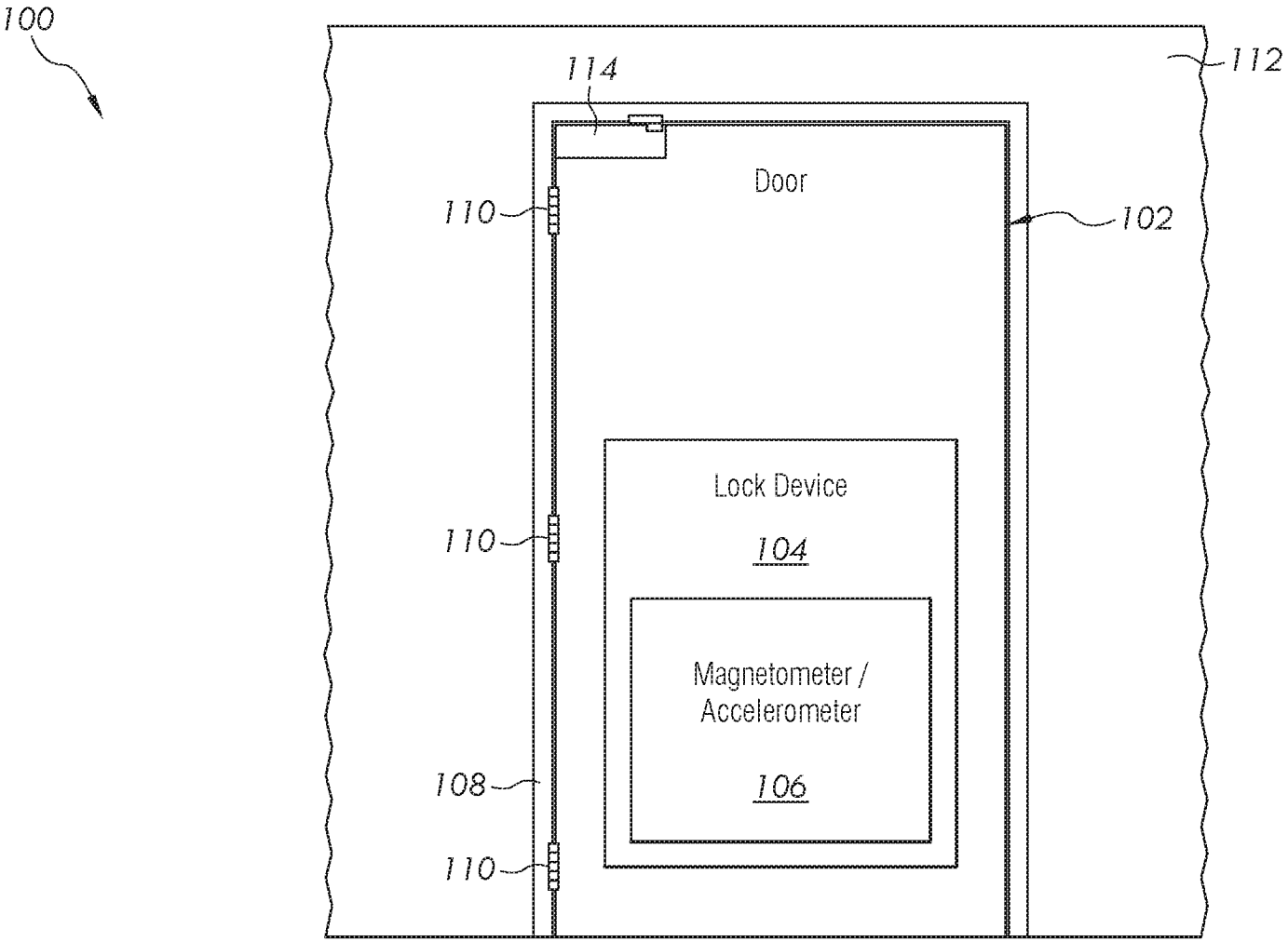
FIG. 2 is a schematic diagram of a lock device attached to a door disposed at a door frame.

With reference to FIG. 2, there is illustrated a schematic view of an example access control system 100. The system 100 includes a door 102 and an electronic lock device 104 operably connected to the door 102. The lock device 104 includes a lock mechanism such as a latch or deadbolt to secure the door 102 in a closed position. The lock device 104 includes a magnetometer/accelerometer component 106. In the embodiment shown in FIG. 2, the magnetometer and accelerometer are in the chip or package. However, it is contemplated that in other embodiments, the magnetometer and accelerometer are be separate chips or packages, or the lock device 104 may include only one of them.

The door 102 is pivotally attached to a frame 108 at a plurality of hinges 110 at a wall 112. In one embodiment, a door operator 114 is coupled to the door 102 and the frame 108 to open and/or close the door, or to locate the door at any position between the open and close position, when provided an instruction. The instruction can be provided remotely or locally. If the instruction is provided locally, a user interface button, either mechanical or touch sensitive, is pressed, or a card reader senses a credential to operate the door. If the instruction is provided remotely, the status, state or condition of the door and/or the door lock can be provided. In addition, the status, in another embodiment, is scheduled by a user or administrator, to schedule a change in status or condition at a predetermined time.

The lock device 104 includes a latch bolt and/or dead bolt (not shown) which engages the frame 108 to maintain the door 102 in a closed or locked position with respect to the frame. In one or more embodiments, the magnetometer is one of a vector magnetometer and a total field magnetometer. In these and other embodiments, the accelerometer is one of a single axis and multi-axis accelerometer. In one embodiment, the accelerometer provides sufficiently accurate measurements of acceleration to determine acceleration or deviations in the velocity of the door when moving from one position to another.

By using the relative door acceleration and relative magnetic field vector from the magnetometer/accelerometer component 106, the lock device 104 makes decisions about itself and surroundings. For example, the magnetometer/accelerometer 106 may be used to detect tailgating. In particular, once the door 102 opens, the accelerometer 106 can be used to detect if the door 102 does not immediately return to a closed state by sensing if the acceleration switches directions. If acceleration switches directions more than once, then someone tailgated the previous person.

Another example is to determine door angle by using the magnetometer data. The lock device determines how many degrees the door 102 is open based on the magnetometer output. This could provide additional information for the lock device's door propped & forced door feature.

Another example is a prep-less door position switch by utilizing the magnetometer and/or accelerator component 106 to calculate if the door 102 is open or closed based off of the accelerometer and magnetometer data collected.

Another example is warning mechanism based on the accelerometer. By sensing the acceleration of the lock device 104, the lock device 104 can provide motion based warnings, or alerts, such as if the building is shaking from an earthquake.

Yet another example is determining door sag. If the door 102 is installed properly, the magnetometer data is stored. If over time that vertical axis of the magnetometer data indicates a change in value, the lock device 104 reports that the door 102 has developed a sag.

Another example is detecting door frame rub. By utilizing the accelerometer, the acceleration is measured when the door 102 is first opened or when it is near the closed position. If the acceleration is not consistent at these stages, the lock device 104 concludes that the door 102 is rubbing the frame when the door 102 is near or at the frame.

Another example is determining triangulation of an intruder. By monitoring the movement of the doors in a corridor, an intruder can be located.

Figure 3:
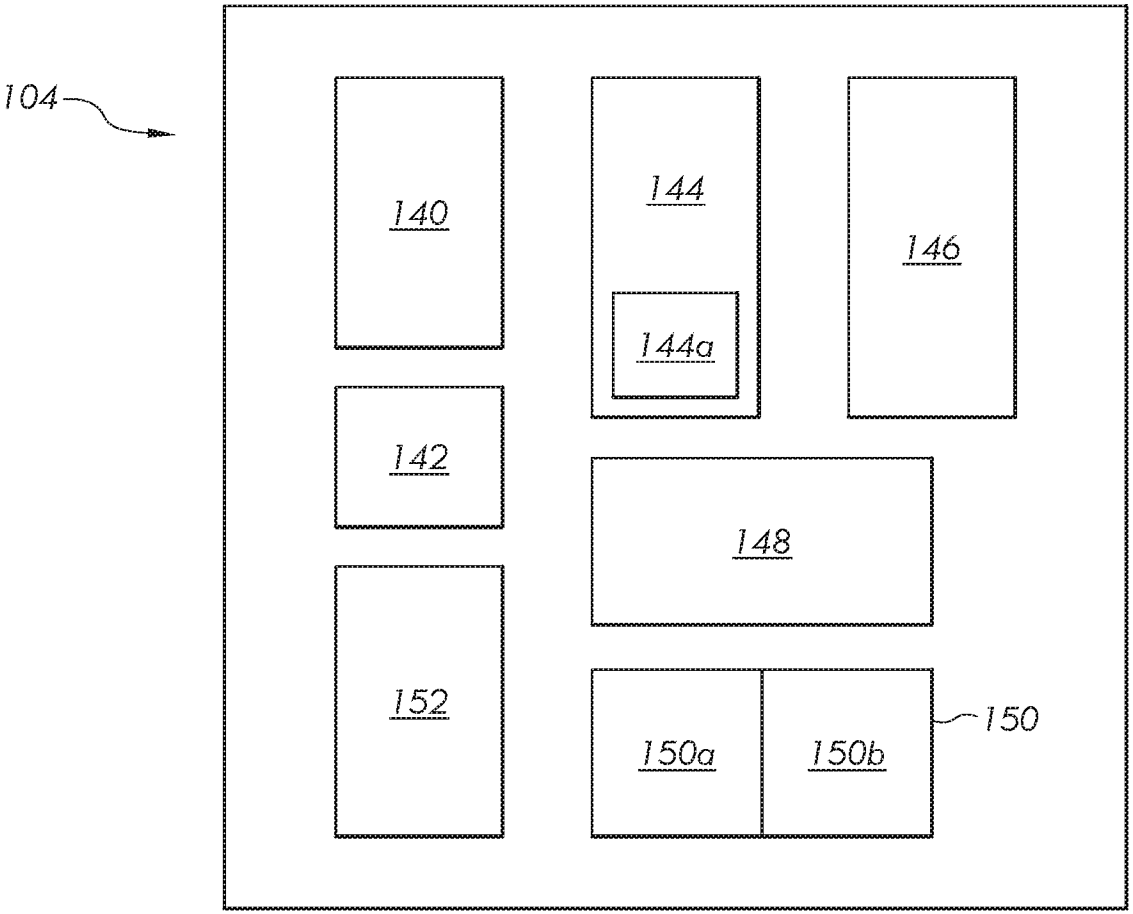
FIG. 3 is a block diagram of a lock device.

In one embodiment, the lock device 104 is a wireless electronic door lock, which is further shown in a block diagram form in FIG. 3. The lock device 104 includes a logic and memory module 140, a suitable power source 142, such as A/C power and/or battery power, a keyless entry system 144, a keyed entry mechanism 146, a locking mechanism 148, a multi-frequency transceiver 150 (receiver and transmitter), and a user interface 152.

The keyless entry system 144 includes a keypad **144*a* for entering an access code and other data. In other embodiments, other data entry systems may be used in place of the keypad, such as biometric entry, smart cards, infrared readers, etc. The keyless entry system 144, in different embodiments, includes a card reader for electronically reading an access code from a card carried by the user. The keyless entry system 144 communicates with the logic and memory module 140 that stores access codes, other user identification information, other data and carrying out the functions of the lock device 104. The logic and memory module 140, in different embodiments, stores individual user codes, where each user having access to the door is issued a unique user code that is stored and compared to input codes at the door to allow access decisions to be made at the door without transmissions over computer network 100**.

In one embodiment, logic and memory module includes a processor that drives communications with RF network 24 and establishes WI-FI connection 26 through appropriate hardware on access device 20 and interface device 16. The logic and memory module 140 may further include an internal memory for storing credential data and audit data, and a real-time clock for determining times associated with access events. In addition, logic and memory module 140 is operable in a low power mode to preserve battery life. In one specific embodiment, logic and memory module 140 includes an advance reduced instruction set computer machine.

Software routines resident in the included memory are executed by the processor to generate signals and in response to the signals received. The executed software routines include one or more specific applications, components, programs, objects, modules, firmware, or sequence of instructions typically referred to as "program code". The program code includes one or more instructions located in memory and other storage devices which execute the operation of the lock device 104. In particular, signals are generated and transmitted by the magnetometer and/or accelerometer 106 to the processor which determines one or more states or conditions of the door with respect to the frame.

The keyed entry mechanism 146, in some embodiments, manually operates the locking mechanism 148, for example in case of power loss or other malfunction. The locking mechanism 148 of the lock device 104 includes locking features such as a sliding deadbolt, or other suitable locking mechanism coupled to a door handle or knob and/or to a key mechanism. In the illustrated construction, the locking mechanism 148 is power-driven, for example by a solenoid or an electric motor, to facilitate remote operation. The lock device 104 may also include a user interface 152 having visual components, such as a display, an LED light and/or an LCD screen, and/or audio components, such as a speaker or other sound-generating device.

Where the lock device 104 is part of a networked system 10, such as that described herein, functions that can be performed remotely through access control device 30 include, but are not limited to, confirming the status of a lock, such as whether the door lock is locked or unlocked, notifying the network of an attempted access, including whether the lock was accessed, when it was accessed and by whom, whether there were attempts at unauthorized access, and other audit information. In some constructions, the lock device 104 can also receive and execute a signal to unlock the lock, add or delete user codes for locks having such codes, and, if the door lock is paired with a suitable camera (not shown), transmit images of the person seeking entry. The lock device 104 can also be used to send a command to disarm an electronic alarm or security system, or to initiate a duress command from the keypad 144*a*, where the duress command may be utilized by the network to transmit a message to access control device 30 or other linked device, such as a computer terminal or mobile device, an electronic alarm or security system, or a networked computer server.

The keypad 144*a* can also be used to program and configure the operation of the lock device 104, such as adding access codes, deleting access codes, enabling audible operation, and setting relocking time delays. Additionally, the lock device 104 includes multi-frequency transceiver 150, or interface, that can include an RF module 150*a* including an antenna or programmable card for the reception and transmission of sub 1-GHz RF signals, a WI-FI module 150*b* configured to establish WI-FI connection 26 to and send and receive WI-FI signals to computer network 12, and all necessary electronic components required for the reception and generation of RF signals and WI-FI connection/disconnection with logic-memory module 140. The WI-FI interface with access control device 30 provides the same operation, programming, and configuration functionality as that afforded by the keypad 144*a*, in addition to a wide range of features including but not limited to audit information such as lock status reporting, lock operation reporting, lock battery status, and the like.

The logic and memory module 140, in different embodiments, is a programmable type, a dedicated, hardwired state machine, or any combination of these. The logic and memory module can include multiple processors, Arithmetic-Logic Units (ALUs), Central Processing Units (CPUs), Digital Signal Processors (DSPs), or the like. The logic and memory module may be dedicated to performance of the operations described herein or may be utilized in one or more additional applications. In the depicted form, logic and memory module is of a programmable variety that executes algorithms and processes data in accordance with operating logic as defined by programming instructions (such as software or firmware) stored in memory. In other embodiments, the memory is separate from the logic and is part of the logic or is coupled to the logic.

The memory is of one or more types, such as a solid-state variety, electromagnetic variety, optical variety, or a combination of these forms. Furthermore, the memory can be volatile, nonvolatile, or a combination of these types, and some or all can be of a portable variety, such as a disk, tape, memory stick, cartridge, or the like. In addition, memory can store data that is manipulated by the operating logic of the logic and memory 108, such as data representative of signals received from and/or sent to input/output device interface devices 16.

Figure 4:
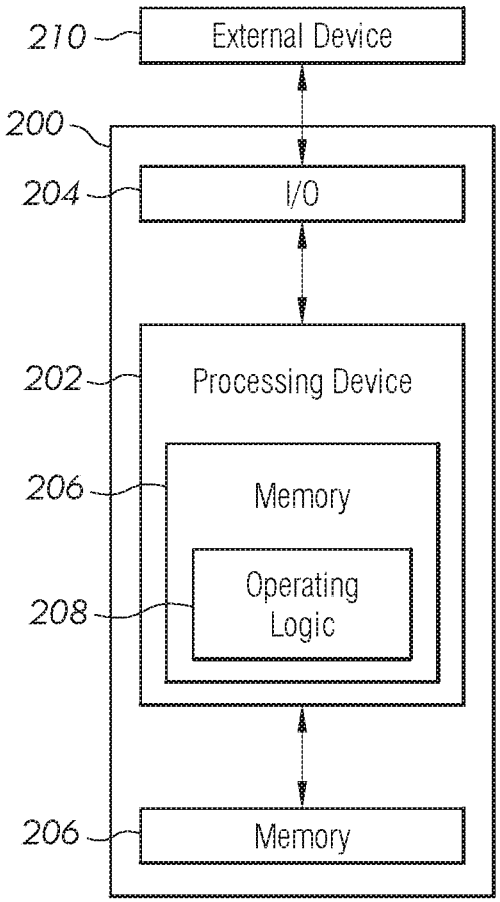
FIG. 4 is a block diagram of a lock device operatively coupled to an external device.

FIG. 4 illustrates another example of a lock device 200 including a processing device 202, which corresponds to the logic and memory module 140, and an input/output device 204, which corresponds to the transceiver 150. A memory 206 and operating logic 208 are also included in the processing device 202. Furthermore, the lock device 200 communicates with one or more external devices 210.

The input/output device 204 allows the lock device 200 to communicate with the external device 210. For example, the input/output device 204 may be a transceiver, network adapter, network card, interface, or a port (e.g., a USB port, serial port, parallel port, an analog port, a digital port, VGA, DVI, HDMI, FireWire, CAT 5, or any other type of port or interface). The input/output device 204 may include hardware, software, and/or firmware. It is contemplated that the input/output device 204 will include more than one of these adapters, cards, or ports.

The external device 210 may be any type of device that allows data to be inputted or outputted from the lock device 200. For example, the external device 210 may be a switch, a router, a firewall, a server, a database, a mobile device, a networking device, a controller, a computer, a processing system, a printer, a display, an alarm, an illuminated indicator such as a status indicator, a keyboard, a mouse, or a touch screen display. Furthermore, it is contemplated that the external device 210 may be integrated into the lock device 200. It is further contemplated that there may be more than one external device in communication with the lock device 200.

Processing device 202 can be a programmable type, a dedicated, hardwired state machine, or any combination of these. The processing device 202 may further include multiple processors, ALUs, CPUs, DSPs, or the like. Processing devices 202 with multiple processing units may utilize distributed, pipelined, and/or parallel processing. Processing device 202 may be dedicated to performance of just the operations described herein or may be utilized in one or more additional applications. In the depicted form, processing device 202 is of a programmable variety that executes algorithms and processes data in accordance with operating logic 208 as defined by programming instructions (such as software or firmware) stored in memory 206. Alternatively or additionally, operating logic 208 for processing device 202 is at least partially defined by hardwired logic or other hardware. Processing device 202 may include one or more components of any type suitable to process the signals received from input/output device 204 or elsewhere, and to provide desired output signals. Such components may include digital circuitry, analog circuitry, or a combination of both.

Memory 206 may be of one or more types, such as a solid-state variety, electromagnetic variety, optical variety, or a combination of these forms. Furthermore, memory 206 can be volatile, nonvolatile, or a combination of these types, and some or all of memory 206 can be of a portable variety, such as a disk, tape, memory stick, cartridge, or the like. In addition, memory 206 can store data that is manipulated by the operating logic 208 of processing device 202, such as data representative of signals received from and/or sent to input/output device 204 in addition to or in lieu of storing programming instructions defining operating logic 208, just to name one example. As shown in FIG. 4, memory 206 may be included with processing device 202 and/or coupled to the processing device 202.

Figure 5:
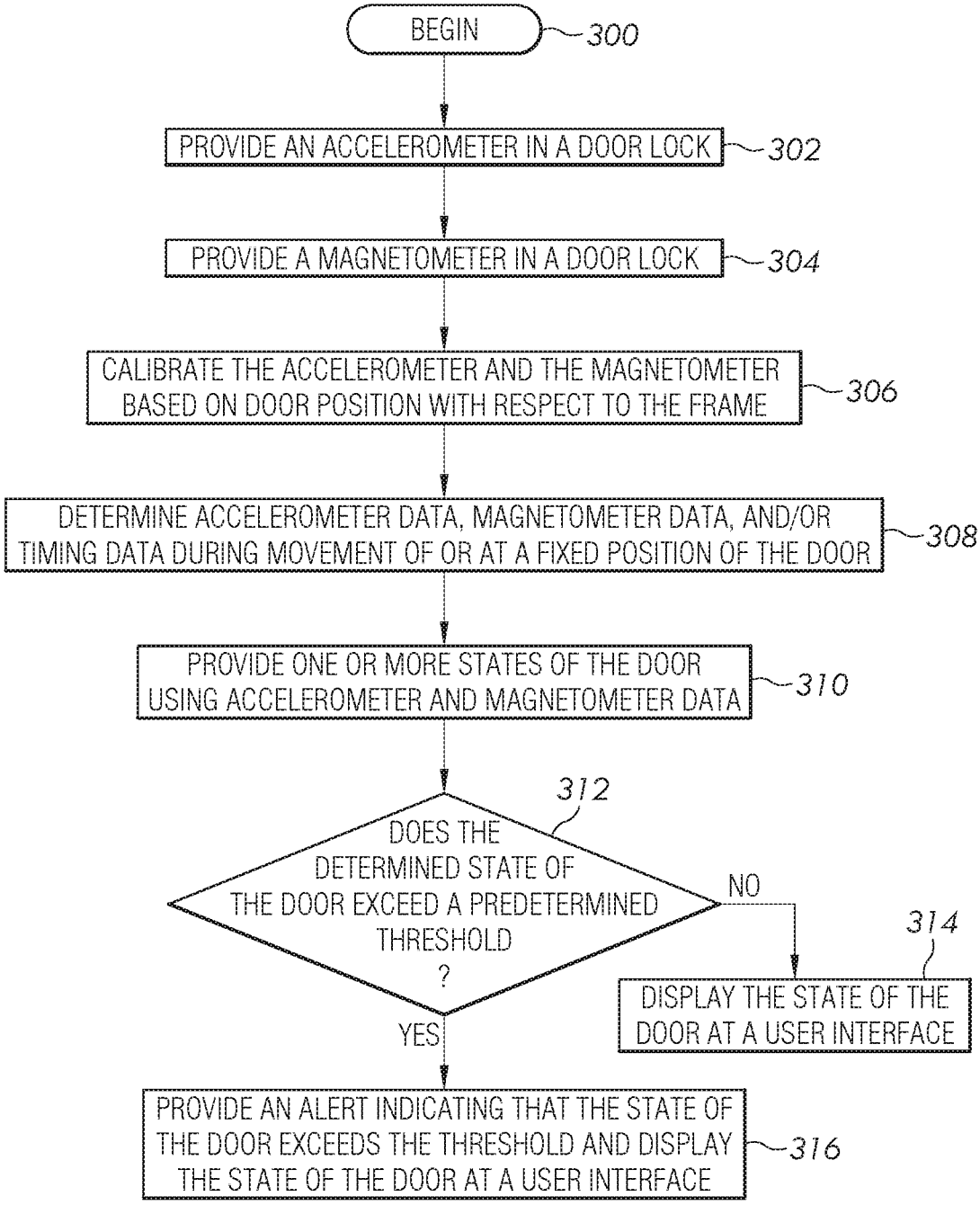
FIG. 5 is a block diagram of a process to determine a status of a door with respect to a door frame.

FIG. 5 illustrates a block diagram of one embodiment of a process to determine a state of a door with respect to a door frame. The process determines the door position at a closed position, an open position, and at the positions between the closed position and the open position. In addition, the process, in different embodiments, is configured to determine one, some of, or all of a position, a velocity and an acceleration of the door. Another feature of the process includes determining a travel time of the door moving from the closed position to any other position up to and including to the open position. The process, in different embodiments, further includes determining a travel time of the door moving from the open position to any other position up to and including the closed position. As described herein, a state of the door, or a door state, includes any stationary position of the door at the door closed position, the door open position, and any location therebetween. In addition, a state of the door further includes a movement of the door, including both acceleration and velocity of a door moving from one position to another position.

As illustrated in FIG. 5, the process begins at block 300. To enable the process, a manufacture or installer provides a door lock having an accelerometer at block 302. In one embodiment, the accelerometer is located within a housing of the lock device 104. In other embodiments, the accelerometer is located in or on the door. In still other embodiments, the accelerometer is located at the door operator 114.

The manufacturer or installer also provides a magnetometer in the door lock which is installed at the door 104 at block 304. For instance, in some embodiments, the magnetometer determines a magnetic field by sensing the presence of a metal. In other embodiments, the magnetometer relies on sensing the presence of a magnet. Consequently, depending on the type of magnetometer being provided, the location of the magnetometer is based on the configuration of the door lock, the door, and the door frame. In one embodiment, the magnetometer is located within a housing of the lock device 104.

In another embodiment, the magnetometer and the accelerometer are configured as a single modular unit or package including both a 3-axis accelerometer and a 3-axis magnetometer. The single unit is located within a housing of the lock device 104. The disclosed embodiments use the accelerometer and magnetometer to collect position, velocity, acceleration and magnetic field vector data. The vector data provides detailed information of the state of the door to enable the processor to determine, for instance, door angle with respect to the frame.

Once the accelerometer and magnetometer have been appropriately located, the manufacture or the installer calibrates both the accelerometer and the magnetometer. The calibration includes determining a magnetic field determined by the magnetometer at the door closed position and the door open position. In addition, positions between the door closed position and the door open position can be calibrated. The accelerometer is also calibrated at block 306.

Once the calibration is complete, the magnetometer and accelerometer are used to determine a number of different states of the door. Accelerometer data, magnetometer data, velocity data, position data and/or timing data are determined during movement of the door or when the door is located at a fixed position at block 308.

In one or more embodiments, the magnetometer 106 determines angular positions of the door. The determined positions are transmitted to the logic-memory module 140 for door applications. In addition, the accelerometer 106 determines an acceleration of the door during movement from the open position to the closed position and from the closed position to the open position. The logic-memory module 140 uses the acceleration data provided by the accelerometer for door applications. In addition, to the acceleration data provided, the logic-memory module 140 is configured to determine angular position (θ) and angular velocity (ω) as follows:

$$\theta=\omega_0 t+\tfrac{1}{2}\alpha t^2$$

Where: θ=Angular Position
t=time $$\omega(t)=\frac{d\theta}{dt}$$

$$\alpha(t)=\frac{d^2\theta}{dt^2}$$

$$\theta(t)=\int\omega(t)dt$$

$$\omega(t)=\int\alpha(t)dt$$

-continued $$\tau = f(sf, gd)$$

Where:

f(sf,dg)=a function of spring force and door geometry.

Once the accelerometer data and magnetometer data have been processed, one or more states, or conditions, of the door are provided by logic-memory module 140 at block 310. The memory is provided with a plurality of operating state thresholds which establish preferred limits of door operation. For instance, acceleration of the door should be maintained within a predetermined range of acceleration by the door operator 114. If the acceleration exceeds a predetermined upper threshold of acceleration, the door is considered to be operating in an unacceptable operating state. As an example, an upper threshold for door acceleration in a hospital could be less than an upper limit for door acceleration in a place of business, since hospital patients and staff can take more time to move from one location to another.

The acceleration data and/or magnetometer data is used in one or more of the following door state detection schemes.

Tailgate detection: Once the door opens, the accelerometer detects if the door doesn't immediately return to a closed state by sensing if the door, and therefore, the door acceleration changes directions. The accelerometer is providing a continuous or discrete stream of acceleration data over a period of time. The processor, which is configured to determine a time period between opening and closing, compares the determined time period a predetermined time period corresponding to a known time to open or time to close the door. If the acceleration switches directions more than once during the determined time period, which is greater than the predetermined time period, then an individual may have tailgated the previous person.

Door Angle Calculation: Using the magnetometer data, the door lock including the magnetometer senses how many degrees the door is open. This angular displacement of the door with the frame provides additional information used by the processor to determine if the door is propped open or is in a forced door condition. For instance, if the angle of the door with respect to the frame remains at an angle of other than zero for a determined amount of time, as determined by the processor, an unacceptable door state is identified by the processor.

Prep-less Door Position Switch Algorithm: By utilizing a prep-less door position switch via the accelerometer & magnetometer, there is a specialized algorithm that will calculate if the door is open or closed based off of the accelerometer & magnetometer data collected. When installing a prep-less switch as described herein, a door position reed switch is no longer necessary to determine door position. Consequently, the door frame does not need to be drilled out to receive a magnet and the door does not need to be drilled out to receive the reed switch, which provides a quicker and better installation of a door.

Accelerometer based Warning Mechanism: By sensing the lock's acceleration, the lock provides motion based warnings, such as if the building is shaking from an earthquake. In this situation, if the accelerometer is providing accelerometer data of other than zero when the door is closed, shaking from an earthquake is a possibility. In this embodiment, an alert is provided. The accelerometer data, in another embodiment, is used to determine if the door is being forced open by sensing movement of the door using the accelerometer.

Door Sag: If the door is installed properly, the magnetometer data at installation is stored. If over period of time, the initially determined magnetometer data of vertical axis alignment changes, such as a decrease in value, the processor of the door lock can report the door is experiencing sag.

Door Frame Rub Detection: By utilizing the accelerometer, the measured acceleration indicates when the door is first opened or when it is closed. If the acceleration is not consistent at these stages, it can be concluded the door is rubbing the frame when located near or moving toward the frame.

Triangulation of an intruder: By monitoring the movement of the doors in a corridor, an intruder is located. In this situation, door conditions are monitored to determine if a sequence of door openings and closing indicates an unusual pattern. For instance, the process monitors door opening and closings in a corridor or throughout a facility over a period of time and stores a determined pattern of openings and closings. When a new pattern of closings and openings is different than the determined patterns, an alert is provided to indicate that an intruder situation could exist and needs to be addressed.

Once the one or more states of the door have been determined and or stored in the logic-memory module 140, a comparison is made between the determined states of the door and one or more of the predetermined thresholds at block 312. If the determined state of the door does not exceed the predetermined threshold, in one embodiment, the state of the door is displayed at a user interface of, for instance, the access control device 30 at block 314. In some embodiments, the state of the door is automatically displayed at the user interface. In other embodiments, the state of the door is accessible by a user through the access control device, but is not automatically displayed.

If, however, the predetermined state of the door exceeds one or more of the predetermined thresholds, an alert is provided at block 316, at the user interface. The alert is configured to indicate to a user that an unacceptable condition has occurred and should be reviewed in more detail. The alert, in one or more embodiments, includes either a visual and/or audible indication that the threshold has been exceeded. Visual alerts include flashing text on a display, highlighted text, flashing lights, lights changing colors, or other visual cues. Audible alerts include voice alerts, and sounds generated by produced to sound like bells, whistles, horns, and sirens. The present disclosure is not limited by the described examples of visual and audible alerts, and other visual and audible alerts are contemplated.

Operations illustrated for all of the processes in the present application are understood to be examples only, and operations may be combined or divided, and added or removed, as well as re-ordered in whole or in part, unless explicitly stated to the contrary.

The present disclosure improves upon the current door hardware by increasing the ability to detect a variety of scenarios. By incorporating accelerometer and magnetometer data, various data points are provided to improve the knowledge available about the state of a door. Such improvements include easier installation to detailed information about the door, not previously available. Such information includes, but is not limited to door angle, door sag, and door information, such as triangulation of an intruder and tailgate detection.

It is contemplated that the various aspects, features, computing devices, processes, and operations from the various embodiments may be used in any of the other embodiments unless expressly stated to the contrary.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. For instance, while a pivoting door is shown, other door configurations are possible including sliding doors and doors on tracks.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A method for determining a status of a door with respect to a passageway, the method comprising:

providing at least one sensor in a door lock;

analyzing sensor data of the door generated by the at least one sensor;

determining whether one or more operating state thresholds are satisfied based on the sensor data, wherein the one or more operating state thresholds indicate that the door is operating in an acceptable operating state when the one or more operating state thresholds are satisfied based on the sensor data thereby indicating that the door is opening and/or closing without a change in direction of door acceleration, and the one or more operating state thresholds indicate that the door is operating in an unacceptable operating state when at least one of the operating state thresholds is unsatisfied based on the sensor data thereby indicating that the door is opening and/or closing with a change in direction of door acceleration; and providing a status of the door with respect to the passageway signifying whether the door is operating in the unacceptable operating state thereby indicating that that the door is opening and/or closing with a change in direction of door acceleration or the acceptable operating state thereby indicating that the door is opening and/or closing without a change in direction of door acceleration.

2. The method of claim 1, wherein providing the status of the door comprises providing an alert indicating that an unacceptable condition associated with operation of the door exists when the door is operating in the unacceptable operating state.

3. The method of claim 1, further comprising determining a magnetic field value generated by a magnetometer when the door is in a closed position relative to the passageway; and wherein providing the alert signal comprises providing an alert signal in response to a determination that magnetometer data is different from the magnetic field value determined when the door is in the closed position relative to the passageway.

4. The method of claim 1, further comprising calibrating a magnetometer by determining a first reference magnetic field sensed by the magnetometer when the door is positioned in a closed state.

5. The method of claim 4, wherein calibrating the magnetometer further comprises determining a second reference magnetic field sensed by the magnetometer when the door is positioned in at least one opened state.

6. The method of claim 1, wherein determining the door is operating in an unacceptable operating state comprises detecting one of a propped door state or a forced door condition.

7. The method of claim 1, wherein determining the door is operating in an unacceptable operating state comprises detecting the door has sagged relative to an installation position of the door.

8. The method of claim 1, wherein determining the door is operating in an unacceptable operating state comprises determining the door is positioned at a nonzero angle relative to the passageway for at least a threshold period of time.

9. An electronic door lock for a door that secures a passageway, the lock comprising:

at least one sensor configured to generate sensor data; and a processor configured to execute stored program instructions to:

determine whether one or more operating state thresholds are satisfied based on the sensor data, wherein the one or more operating state thresholds indicate that the door is operating in an acceptable operating state when the one or more operating state thresholds are satisfied based on the sensor data thereby indicating that the door is opening and/or closing without a change in direction of door acceleration, and the one or more operating state thresholds indicate that the door is operating in an unacceptable operating state when at least one of the operating state thresholds is unsatisfied based on the sensor data thereby indicating that the door is opening and/or closing with a change in direction of door acceleration; and provide a status of the door with respect to the passageway indicative of whether the door is operating in the unacceptable operating state thereby indicating that the door is not opening and/or closing with a change in direction of door acceleration or the acceptable operating state thereby indicating that the door is opening and/or closing without a change in direction of door acceleration.

10. The electronic door lock of claim 9, wherein the processor is further configured to provide an alert indicating that an unacceptable condition associated with operation of the door exists when the door is operating in the unacceptable operating state.

11. The electronic door lock of claim 9, wherein the processor is further configured to:

determine a magnetic field value generated by a magnetometer when the door is in a closed position relative to the passageway to provide magnetometer data; and provide a signal in response to a determination that the magnetometer data is different from the magnetic field value determined when the door is in the closed position relative to the passageway.

12. The electronic door lock of claim 9, wherein the processor is further configured to determine whether a second set of one or more operating state thresholds are satisfied based on the sensor data, wherein the second set of one or more operating state thresholds indicate that the door is operating in an acceptable operating state when the second set of one or more operating state thresholds are satisfied based on the sensor data, and the second set of one or more operating state thresholds indicate that the door is operating in an unacceptable operating state when at least one of the second set of operating state thresholds is unsatisfied based on the sensor data.

13. The electronic door lock of claim 9, wherein the processor is configured to determine whether the one or more operating state thresholds are satisfied based on sensor data, wherein the one or more operating state thresholds indicate that the door is operating in an acceptable operating state when the one or more operating state thresholds are satisfied based on the sensor data, and the one or more operating state thresholds indicate that the door is operating in an unacceptable operating state when at least one of the operating state thresholds is unsatisfied based on the sensor data.

14. The electronic door lock of claim 9, wherein the at least one sensor includes a magnetometer comprising at least one of a vector magnetometer or a total field magnetometer.

15. A method for determining a status of a door, the method comprising:

analyzing sensor data related to movement of the door generated by at least one sensor in a door lock;

determining whether a plurality of operating state thresholds are satisfied based on the sensor data, wherein each of the operating state thresholds indicates that operation of the door is operating in an acceptable operating state when the plurality of operating state thresholds are satisfied based on the sensor data thereby indicating that the door is opening and/or closing without a change in direction of door acceleration, and that operation of the door is operating in an unacceptable operating state when at least one of the plurality of operating state thresholds fails to be satisfied based on the sensor data thereby indicating that the door is opening and/or closing with a change in direction of door acceleration; and providing a status of the door with respect to the opening signifying whether the door is operating in the unacceptable operating state thereby indicating that the door is opening and/or closing with a change in direction of door acceleration or the acceptable operating state thereby indicating that the door is opening and/or closing without a change in direction of door acceleration.

16. The method of claim 15, wherein the at least one sensor includes a magnetometer.

17. The method of claim 15, wherein the at least one sensor comprises an accelerometer and the sensor data comprises accelerometer data.

18. The method of claim 15, wherein the at least one sensor comprises a magnetometer and an accelerometer, and the sensor data comprises magnetometer data and accelerometer data.

19. The method of claim 15, wherein providing the status of the door comprises providing an alert indicating that an unacceptable condition associated with operation of the door exists when the door is operating in the unacceptable operating state.

20. The method of claim 15, wherein determining the door is operating in an unacceptable operating state comprises detecting at least one of a propped door state, a forced door condition, door sag relative to an installation position of the door, a tailgate condition, or a frame rub condition.

21. A method for determining a status of a door with respect to a passageway, the method comprising:

providing a magnetometer in a door lock;

analyzing magnetometer data of the door generated by the magnetometer;

determining whether one or more operating state thresholds are satisfied based on the magnetometer data, wherein the one or more operating state thresholds indicate that the door is operating in an acceptable operating state when the one or more operating state thresholds are satisfied based on the magnetometer data, and the one or more operating state thresholds indicate that the door is operating in an unacceptable operating state when at least one of the operating state thresholds is unsatisfied based on the magnetometer data thereby indicating that the door is in a propped state or a forced door condition; and providing a status of the door with respect to the passageway signifying whether the door is operating in the unacceptable operating state thereby indicating that the door is in the propped state or the forced door condition or the acceptable operating state.

22. An electronic door lock for a door that secures a passageway, the lock comprising:

a magnetometer configured to generate magnetometer data based on a sensed magnetic field; and a processor configured to execute stored program instructions to:

determine whether one or more operating state thresholds are satisfied based on the magnetometer data, wherein the one or more operating state thresholds indicate that the door is operating in an acceptable operating state when the one or more operating state thresholds are satisfied based on the magnetometer data, and the one or more operating state thresholds indicate that the door is operating in an unacceptable operating state when at least one of the operating state thresholds is unsatisfied based on the magnetometer data thereby indicating that the door has sagged relative to an installation position of the door; and provide a status of the door with respect to the passageway indicative of whether the door is operating in the unacceptable operating state thereby indicating that the door has sagged relative to the installation position of the door or the acceptable operating state.

23. A method for determining a status of a door, the method comprising:

analyzing sensor data related to movement of the door generated by at least one sensor in a door lock;

determining whether a plurality of operating state thresholds are satisfied based on the sensor data, wherein each of the operating state thresholds indicates that operation of the door is operating in an acceptable operating state when the plurality of operating state thresholds are satisfied based on the sensor data, and that operation of the door is operating in an unacceptable operating state when at least one of the plurality of operating state thresholds fails to be satisfied based on the sensor data thereby indicating the door is positioned at a nonzero angle relative to the passageway for at least a threshold period of time; and providing a status of the door with respect to the opening signifying whether the door is operating in the unacceptable operating state thereby indicating the door is positioned at the nonzero angle relative to the passageway for at least the threshold period of time or acceptable operating state.

* * * * *